US005723055A

United States Patent [19]

Janssen et al.

[11] Patent Number: 5,723,055

[45] Date of Patent: Mar. 3, 1998

[54] NOZZLE ASSEMBLY HAVING INERT GAS DISTRIBUTOR

[75] Inventors: Dominique Janssen, Tyler, Tex.; Jose Antonio Faria Simoes, Saint Ghislain, Belgium; Robert O. Russell, Twinsburg, Ohio

[73] Assignees: Vesuvius Crucible Company, Wilmington, Del.; LTV Steel Company, Inc., Cleveland, Ohio

[21] Appl. No.: 677,239

[22] Filed: Jul. 9, 1996

Related U.S. Application Data

[63] Continuation-in-part of Ser. No. 541,760, Oct. 10, 1995, abandoned.

[51] Int. Cl.[6] ..... B22D 41/08

[52] U.S. Cl. ..... 222/603; 266/220; 222/601

[58] Field of Search ..... 222/602, 603, 222/594, 597; 266/220, 271, 236

[56] References Cited

U.S. PATENT DOCUMENTS

| | | | |
|---|---|---|---|
| 3,337,329 | 8/1967 | Finkl | 222/602 |
| 4,202,533 | 5/1980 | Daussan et al. | 266/271 |
| 4,360,190 | 11/1982 | Ato | 222/603 |
| 4,421,257 | 12/1983 | Thrower | 222/603 |
| 4,756,452 | 7/1988 | Tsukamoto et al. | 222/603 |
| 4,836,508 | 6/1989 | Fishler | 266/220 |
| 5,016,788 | 5/1991 | Hanse et al. | 222/603 |
| 5,100,035 | 3/1992 | Dunworth et al. | 222/603 |
| 5,137,189 | 8/1992 | Hall et al. | 222/603 |

FOREIGN PATENT DOCUMENTS

| | | |
|---|---|---|
| 0576212 | 12/1993 | European Pat. Off. . |
| 61-206600 | 1/1986 | Japan . |
| 02241667 | 12/1990 | Japan . |
| 4100662 | 4/1992 | Japan . |
| 6106315 | 4/1994 | Japan . |
| 1368390 | 9/1974 | United Kingdom . |
| 2157210 | 10/1985 | United Kingdom . |

*Primary Examiner*—Scott Kastler

*Attorney, Agent, or Firm*—Sixbey Friedman Leedom & Ferguson; Thomas W. Cole

[57] ABSTRACT

A refractory nozzle assembly is provided that effectively prevents the accumulation of alumina deposits around its upper edge where it receives a stopper rod. The nozzle assembly includes a refractory nozzle body having an upper and a lower portion. A bore extends through both the upper and lower portions that has a receiving and a discharge end for receiving and discharging molten metal. An inert gas distributor circumscribes the upper portion of the nozzle body. A sleeve of gas-obstructing refractory material covers the walls of the bore, and defines a seat portion at an upper portion of the bore. A metal sheath substantially surrounds the outer surface of the upper portion. Pressurized inert gas conducted to the upper, gas permeable portion of the nozzle body by the gas-distributing assembly is guided by the gas-obstructing sleeve and the metal sheath so that it flows predominantly through the top edge of the upper portion. The resulting inert gas flow shields the seat portion of the bore from ambient oxygen, thereby preventing the accumulation of alumina deposits on the seat portion that can interfere with the ability of the stopper rod to control the flow of molten metal.

23 Claims, 4 Drawing Sheets

NOZZLE ASSEMBLY HAVING INERT GAS DISTRIBUTOR

BACKGROUND OF THE INVENTION

This is a continuation-in-part of U.S. patent application Ser. No. 08/541,760 filed Oct. 10, 1995, now abandoned.

This invention generally relates to refractory nozzle assemblies, and is specifically concerned with a nozzle for use in combination with a stopper rod having an inert gas distributor for preventing the unwanted accumulation of alumina deposits around the area where the rod seats over the nozzle bore.

Nozzles for controlling a flow of molten metal, such as steel, are known in the prior art. Such nozzles are often used in combination with slide gate valves to modulate a flow of liquid steel incident to steel making processes. In the 1970's, the manufacture of aluminum-killed steels became one of the most common products of the steel making industry due to their desirable metallurgical properties. Unfortunately, such steels resulted in the unwanted deposition of alumina and other refractory compounds around the inner surface of the nozzle bore. If not prevented, it was found that such deposits could ultimately cause the complete blockage of the nozzle assembly used in manufacturing such steels.

To solve the alumina deposition problem, nozzle assemblies having porous, gas-conducting refractory elements were developed. Examples of such nozzles are present in U.S. Pat. Nos. 4,360,190; 5,100,035, and 5,137,189. In operation, pressurized inert gas (such as argon) is conducted through the porous refractory elements, which define some or all of the surface of the metal-conducting bore of the nozzle assembly. The resulting flow of small argon bubbles through the sides of the bore effectively prevents or at least retards the deposition of unwanted alumina in this area. While such prior art nozzle assemblies have been found to operate satisfactorily in instances where the nozzle assemblies are used in connection with slide gate valves, the inventors have observed that the gas-conducting, porous elements in such nozzles do not effectively stop the deposition of unwanted deposits around the top edge of such nozzle assemblies when they are used in combination with stopper rods to modulate a flow of molten steel. This is a significant drawback, as such localized top edge deposits can effectively destroy the ability of the stopper rod to accurately modulate a flow of liquid steel through the nozzle assembly.

After conducting extensive research on the aforementioned problem, the applicants discovered that the unwanted deposits were caused by the negative pressure created within the interior of the nozzle bore as the stopper rod was raised or lowered over the top edge of the nozzle assembly. The resulting negative pressure causes the argon or other inert gas to flow only through the sidewalls of the bore, and causes air aspiration across the nozzle towards the bore, where the oxygen in the air reacts with the aluminum in the steel to generate alumina.

Clearly, there is a need for an improved nozzle assembly having an inert gas distributor capable of effectively conducting an inert gas through the top edge of the assembly to prevent the deposition of alumina deposits in the area where a stopper rod seats itself over the nozzle. Ideally, such a nozzle assembly would create an argon gas barrier that prevents air from contacting the flow of steel over the portion of the nozzle surface that defines the stopper rod seating area. The nozzle assembly should also be easy and inexpensive to manufacture, and have a long service life.

Finally, it would be desirable if the particular gas distributor were retrofittable onto nozzles of conventional design so that the benefits of the invention could be realized without the need for the complete redesign of an existing nozzle.

SUMMARY OF THE INVENTION

Generally speaking, the invention is a nozzle assembly for use in combination with a stopper rod for controlling a flow of molten metal having an inert gas distributor for preventing the deposition of unwanted alumina deposits where the stopper rod seats onto the nozzle assembly. In the first two embodiments of the invention, the nozzle assembly comprises a nozzle body having an upper portion formed from a porous, gas conducting refractory material, and a bore extending through the upper and lower portions for receiving and discharging a flow of molten metal such as steel. An inert gas distributor circumscribes the upper portion of the nozzle body for conducting a flow of inert gas to only the upper nozzle portion. A sleeve of relatively non-gas conducting refractory material covers the porous refractory material defining the upper portion of the nozzle bore to prevent pressurized inert gas from flowing through the sides of the bore. The upper portion of the sleeve also defines a seat portion for receiving a stopper rod. The outer surface of the upper portion of the nozzle body is covered with a layer of gas-impermeable material, such as metal sheathing, to insure that any pressurized, inert gas entering the porous upper portion of the nozzle body will be discharged only out of the top edge of the upper portion. The negative pressure resulting from the flow of molten metal through the nozzle bore will not be able to divert the inert gas across the non-porous sleeve and into the negative pressure zone.

In the third and fourth embodiments, the nozzle assembly comprises a nozzle body as previously described having an upper portion formed from a ceramic material having a moderate porosity. While most of the exterior of the nozzle body is covered with a gas impermeable sheet material, such as metal sheathing, the uppermost portion of the nozzle body is left exposed. Porous ramming material in turn surrounds the metal sheathing. An inert gas distributor in the form of an annular conduit circumscribes the sheathing on the upper portion of the nozzle body. The annular conduit has a plurality of gas conducting openings for distributing inert gas through the ramming material and around the upper end of the nozzle body. When molten steel is conducted through the nozzle bore, the resulting negative pressure pulls the inert gas through the exposed, uppermost portion of the moderately porous nozzle body and over the seat portion of the sleeve, thereby preventing air from penetrating the uppermost portion of the nozzle body.

In the first two embodiments of the nozzle assembly, the gas obstructing sleeve of refractory material covers all or substantially all of the bottom portion of the bore as well as the top portion. The lower portion of the nozzle body is preferably formed from a pressed, low permeability refractory while the upper portion is formed from a high permeability pressed refractory. A source of pressurized, inert gas is provided that preferably includes a gas conduit having an outlet end that terminates in an annular groove in the porous refractory material forming the upper portion of the nozzle body. The groove may be located either around the side or around the bottom of the porous refractory material. The lower portion of the nozzle body may be formed from a low cement alumina that is castable to expedite the manufacturing of the nozzle assembly. The use of such a castable refractory also facilitates the installation of the conduit of the source of pressurized, inert gas.

In the third and fourth embodiments of the invention, both the upper and lower portions of the nozzle body may be formed from high alumina or other refractory that is moderately gas permeable. The inert gas distributor may take the form of an annular conduit or a double-skinned section of the metal sheathing material. In both instances, the gas conducting passages are preferably oriented downwardly to minimize clogging from the surrounding material.

In all embodiments of the invention, the gas-conducting and gas-distributing parts of the nozzle assembly allow a sufficient amount of inert gas to be conducted through or around the top portion of the bore to shield the seat portion of the bore from atmospheric oxygen that can create unwanted alumina deposits.

BRIEF DESCRIPTION OF THE SEVERAL FIGURES

DETAILED DESCRIPTION OF THE PREFERRED EMBODIMENT

Figure 1:
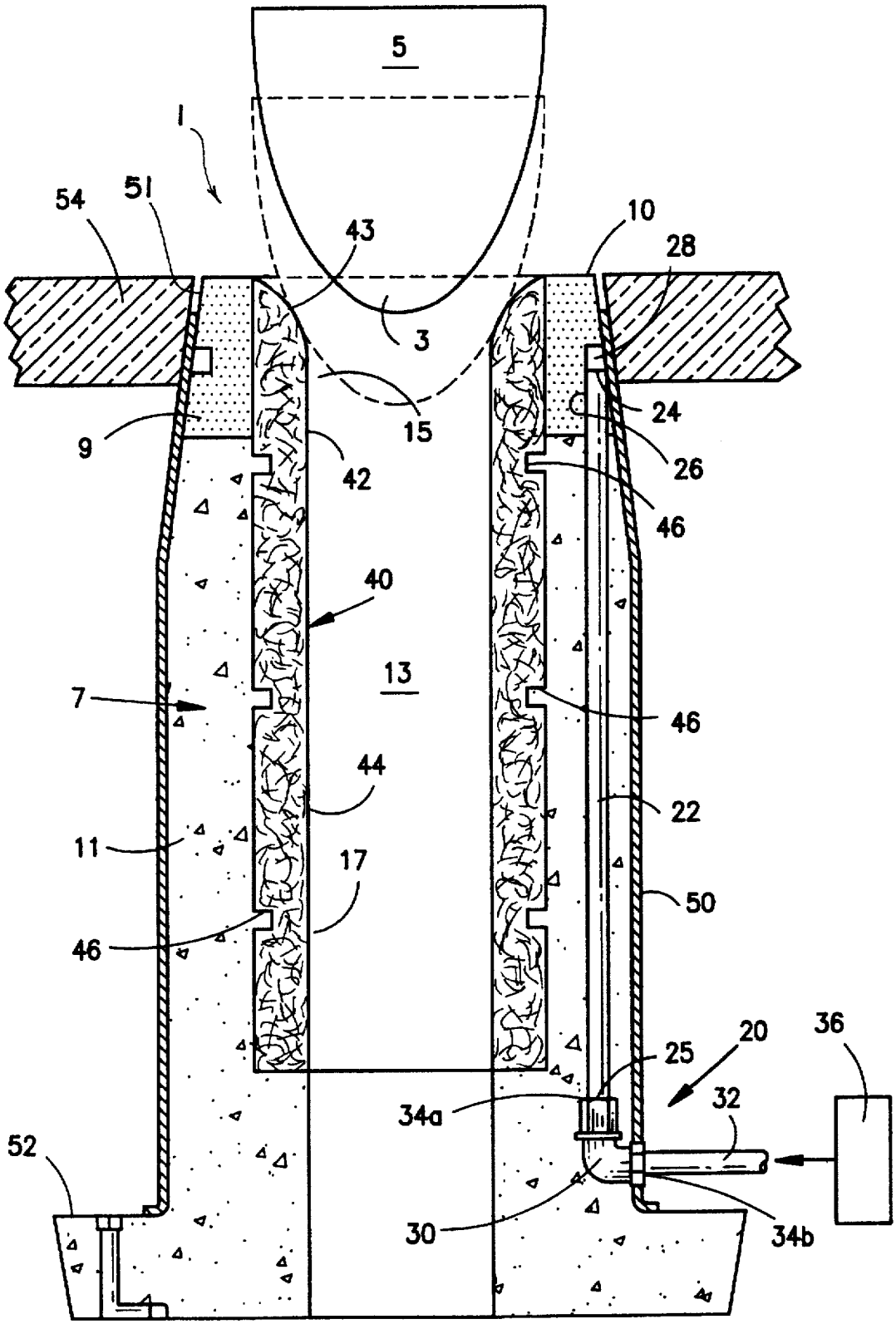
FIG. 1 is a cross-sectional side view of the nozzle assembly of the invention in combination with a stopper rod.

With reference now to FIG. 1, the nozzle assembly 1 of the invention is particularly adapted for use in combination with the end 3 of a stopper rod 5 in order to modulate a flow of molten metal, such as steel.

This first embodiment of the nozzle assembly 1 comprises a nozzle body 7 having an upper portion 9 formed from an annulus of porous, gas permeable refractory material. In the preferred embodiment, the annular upper portion 9 is formed from a pressed highly permeable refractory (which may be magnesia) having a porosity between 25% and 30%. Upper portion 9 terminates in top edge 10. The nozzle body 7 further includes a lower portion 11 formed from a low cement, high alumina castable refractory having a porosity of between 15% and 20%. A cylindrical bore 13 extends along the center line of the generally tubular nozzle body 7. As will be described in greater detail hereinafter, the upper portion 15 of the bore 13 is lined by a relatively non-permeable sleeve 40, while its lowermost portion 17 is defined predominantly by the relatively non-porous lower portion 11 of the nozzle body 7. The bore 13 conducts a flow of molten metal, such as steel, which is introduced through its upper portion 15 and is discharged through its lower portion 17.

A source 20 of pressurized, inert gas is provided for conducting a flow of argon through the annular upper portion 9 of the nozzle body 7. Gas source 20 includes a conduit 22 vertically disposed throughout both the lower and upper portions 11, 9 of the nozzle body 7 as shown. In the preferred embodiment, the conduit 22 may be formed from either carbon steel or stainless steel. Conduit 22 includes an outlet end 24 and an inlet end 25. The outlet end 24 is disposed within a bore 26 in the annular porous upper portion 9 of the nozzle body 7. Bore 26 communicates with an annular groove 28 that circumscribes the upper portion 9. The inlet end 25 of the conduit 22 is connected to a top end of an elbow joint 30, while the gas supply conduit 32 is connected to the side end of the joint 30. Braze joints **34*a,b* are used to connect conduits 22 and 32 to the elbow joint 30 in order to insure leak-free connections. Supply conduit 32 is in turn connected to a tank 36** of pressurized argon (shown schematically).

Nozzle assembly 1 further includes a tubular inner sleeve 40 of a relatively low permeability refractory material for lining all of the upper portion 15 and a substantial mount of the lower portion 17 of the bore 13. Inner sleeve 40 is preferably formed from a pressed refractory, which may be magnesia, having a porosity of between about 13% and 14%. At its upper end, sleeve 40 includes a trumpet-shaped inlet 43 that forms the seating area of the bore 13 for the stopper rod 5, and also serves to funnel molten steel or other metal into the upper portion 15 of the bore 13. The geometry of the rounded shapes of the end 13 of the stopper rod 5 and the trumpet-shaped inlet 43 of the inner sleeve 40 provide a sealing engagement between these two elements when the end 3 of the stopper rod 5 is dropped into the position shown in phantom. The lower portion 44 of the inner sleeve 40 substantially defines the inner surface of the bore 13. The outer surface of the inner sleeve 40 includes one or more locking grooves 46 that help to secure the sleeve 40 to the lower portion 11 of the nozzle body 7 when the lower portion 11 is cast around the sleeve 40 in a manner to be described shortly.

A metal sheath 50 surrounds and covers the exterior surface of the nozzle body 7. In all preferred embodiments, the metal sheath 50 is formed from steel. The top end of the metal sheath 50 terminates just below the top edge of the upper portion 9 of the nozzle body 7, leaving an annular exposed portion 51, while the bottom end flares outwardly to engage a mounting flange 52 that forms the bottom of the nozzle body 7.

Figure 2:
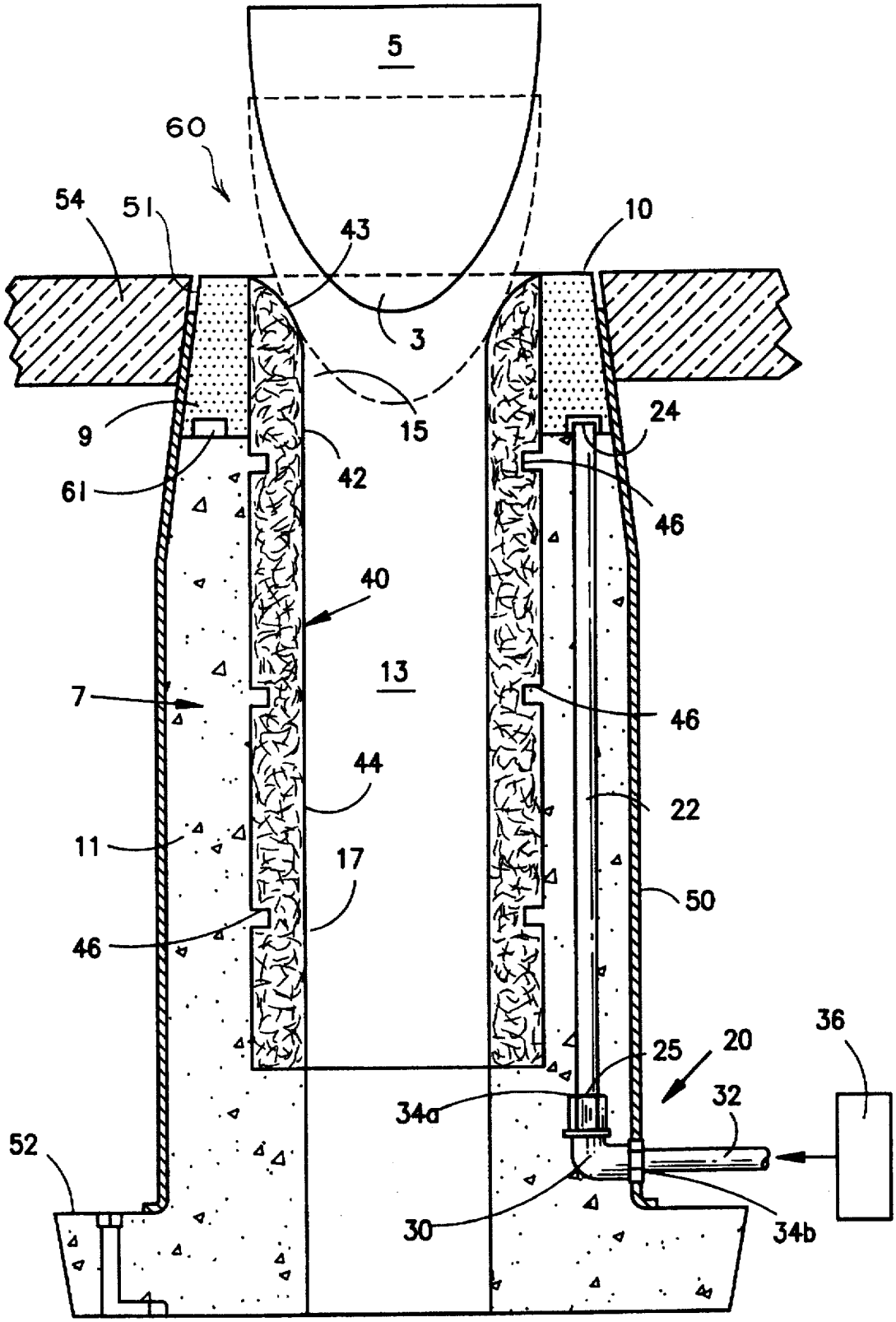
FIG. 2 illustrates a second embodiment of the invention wherein the outlet end of the conduit of the pressurized gas source is mounted differently in the porous upper portion of the nozzle body.

FIG. 2 illustrates a second embodiment 60 of this invention which is in all respects the same as the first embodiment with the exception of the manner in which the outlet end 24 of the conduit 22 communicates with the upper portion 9 of the nozzle body 7. In this embodiment 60, bore 26 and annular groove 28 are replaced by an annular groove 61 present on the bottom surface of the upper portion 9. The outlet end 24 of the gas-conducting conduit 22 communicates with this groove 61 in the manner illustrated. This second embodiment 60 of the invention is somewhat easier to manufacture, as it does not require that the outlet end 24 of the gas-conducting conduit 22 be placed within a bore 26 in the upper portion of the nozzle 7 prior to the casting of the lower portion 11. Instead, the outlet end 24 may be placed at any point within the annular groove 61.

The structure of both of the embodiments 1 and 60 of the invention facilitates the manufacture of the nozzle assembly 1. After the upper portion 9 of the nozzle body 7 and the inner sleeve 40 are fabricated, they are then connected together and installed in the metal sheath 50, sheath 50 is then inverted. Next, gas-conducting conduit 22 is installed either in the bore 26 or the annular groove 61, depending upon which embodiment of the invention is being manufactured. Finally, the lower portion 11 of the nozzle body 7 is cast utilizing the outer surface of the sleeve 40 and the inner surface of the sheath 50 as a mold. Other mold elements (not shown) surround the lower flange of the sheath 50 so that the mounting flange 52 may be integrally cast into the nozzle body 7.

In operation, the top end of the nozzle assembly 1 may be installed in a bore present in a cap block 54 after the nozzle body 7 has been surrounded with ramming material (not shown in FIGS. 1 and 2). Next, pressurized argon is conducted through the conduits 32 and 22 into either the annular groove 28 or 61 of the porous upper portion 9 of the nozzle body 7, depending upon which embodiment of the invention is in use. The gas flow in this example should be between 5–15 liters per minute (or 10–30 standard cubic feet per hour) In all cases, the flow should be high enough to insure adequate shielding of the edge 10 and seating area of the trumpet-shaped inlet 43 from ambient oxygen, but low enough to prevent contamination of the flow of molten metal with gas bubbles. The relatively low permeability of the inner sleeve 43 and the metal sheath 50 and the castable material forming the lower portion 11 forces the pressurized argon to exit the annular upper portion 9 of the nozzle body 7 only out of the top edge 10 as shown. The continuous flow of argon displaces ambient oxygen and prevents the unwanted deposition of alumina or other refractory compounds over these areas as the stopper rod 5 reciprocates within the nozzle assembly 1 to modulate a flow of liquid steel or other metal.

Figure 3:
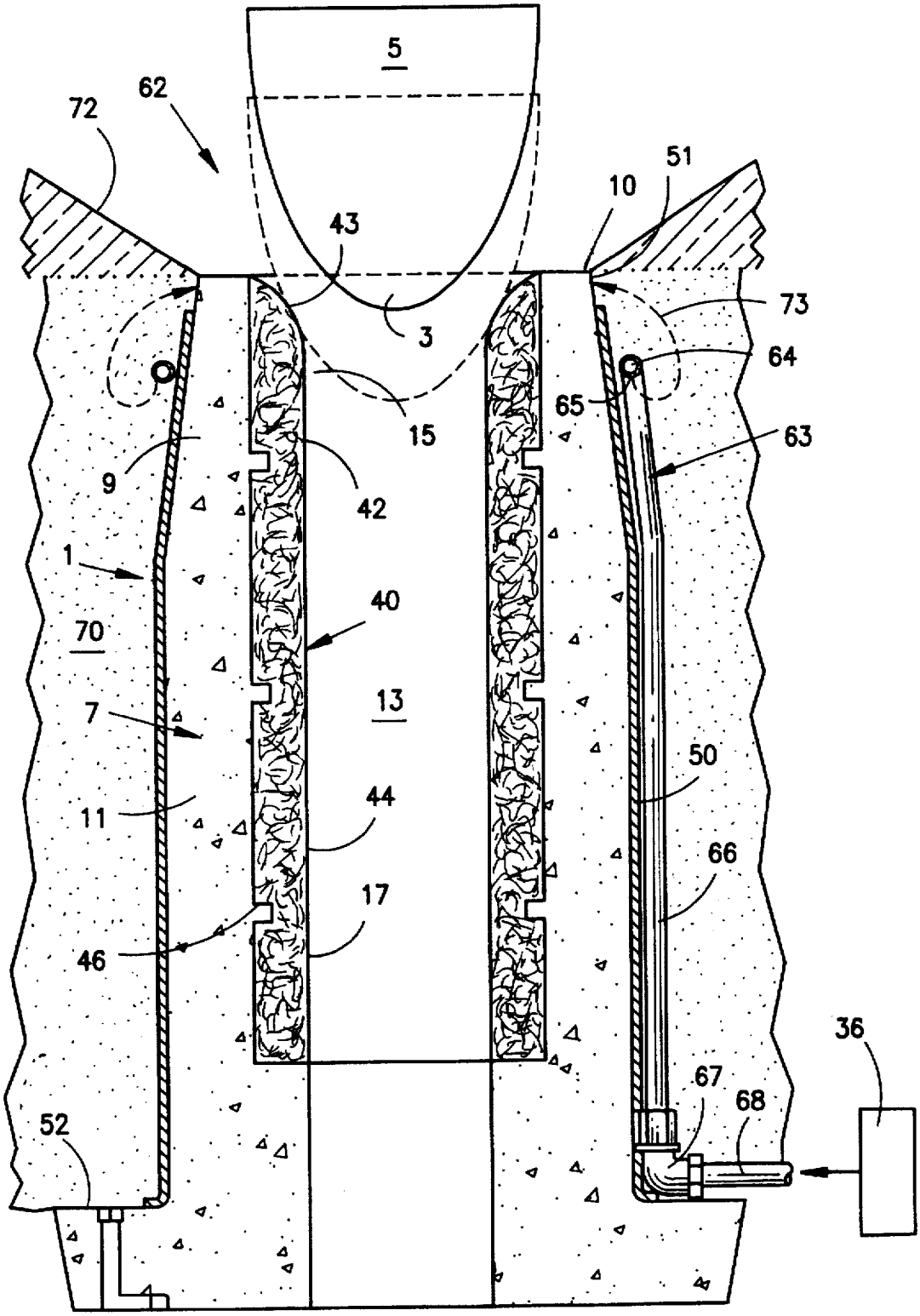
FIG. 3 is a cross-sectional side view of a third embodiment of the invention that utilizes a gas distributor that circumscribes the upper end of the nozzle body.
Figure 4:
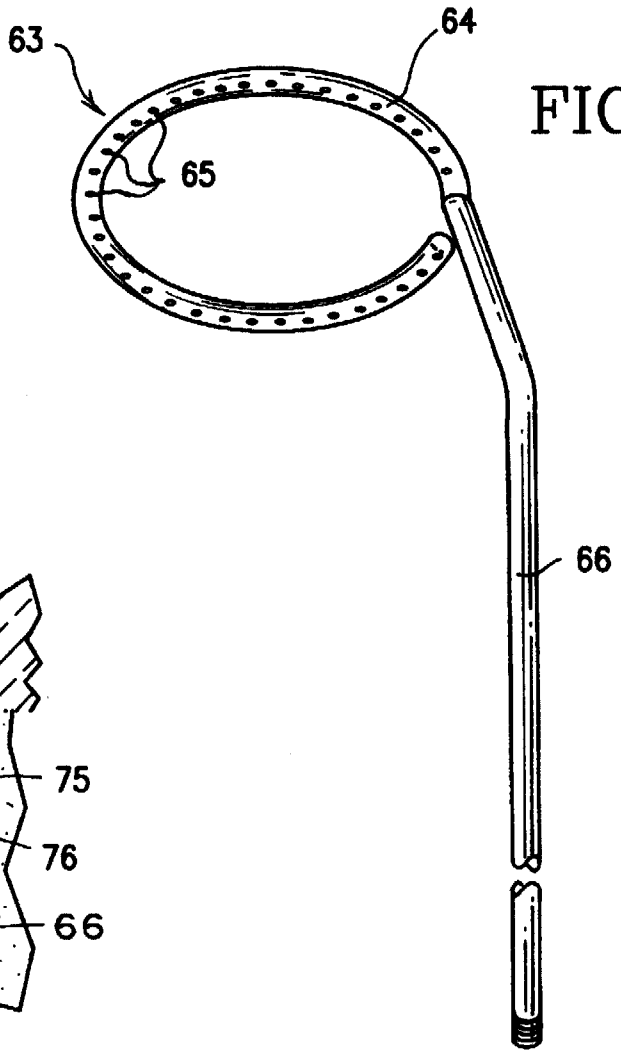
FIG. 4 is a perspective view of a conduit-type gas distributor that may be used in the second embodiment of the invention.

FIGS. 3 and 4 illustrate the third embodiment 62 of the invention, and the inert gas distributor 63 used therein. In this embodiment, both the upper and lower portions 9, 11 of the nozzle body 7 are formed from the same type of low cement, castable alumina that form the lower portion 11 of the nozzle body 7 in the previously described embodiments. While such alumina is not as porous as the previously-discussed refractory that forms the upper portion 9 of the first and second embodiments, it is important to understand that it is still moderately gas permeable, having a porosity of between 15 and 20%, and most usually about 18%. The inert gas distributor 63 includes an annular gas distributing head 64 best seen in FIG. 4. A plurality of gas conducting openings 65 are uniformly spaced at the bottom of the tubular ring forming the head 64. The head 64 is integrally connected with a vertically extending supply conduit 66. Elbow joint 67 connects the supply conduit 66 with a horizontally oriented gas conduit 68 which in turn is connected to a tank 36 of pressurized argon.

As previously indicated, the exterior of the nozzle body 7 is surrounded by a granular ramming material 70. This material 70 is hand packed around the nozzle 1 incident to its installation, and is highly gas permeable, having a porosity of between 20% and 40%. The top of the ramming material 70 is covered by a sprayed-on refractory material of lesser porosity (and hence of lesser gas conductivity) than the ramming material 70. Locating the gas conducting openings 65 around the bottom portion of the annular head 64 helps to prevent them from becoming clogged when the ramming material 70 is hand-packed around the body 7 of the nozzle assembly 62.

In operation, pressurized argon is conducted through the gas conducting openings 65 of the distributor head 64 as molten steel is poured through the bore 13 of the nozzle assembly 62. Like the previously described embodiments, the flow rate of gas is regulated to between 5–15 liters per minute. As indicated by the phantom flow arrows 73, this gas flows through the annular exposed portion 51 of the nozzle body 7 and through the upper edge 10 in the vicinity of the trumpet-shaped taper 43 as a result of both the porosity of the ramming material 70 and the alumina forming the upper portion 9 of the nozzle body 7, and the negative pressure (on the order to −10 psi) applied to this region of the nozzle as a result of the flow of molten steel through the bore 13. For all these reasons, the phantom flow arrows 73 approximate the path of least resistance for the pressurized gas flowing from the annular head 64. The resulting shielding flow of inert gas around the trumpet-shaped taper 43 that forms the seating portion of the nozzle body 7 for the stopper rod 5 prevents ambient oxygen from creating unwanted alumina deposits in this portion of the nozzle assembly 62.

Figure 5:
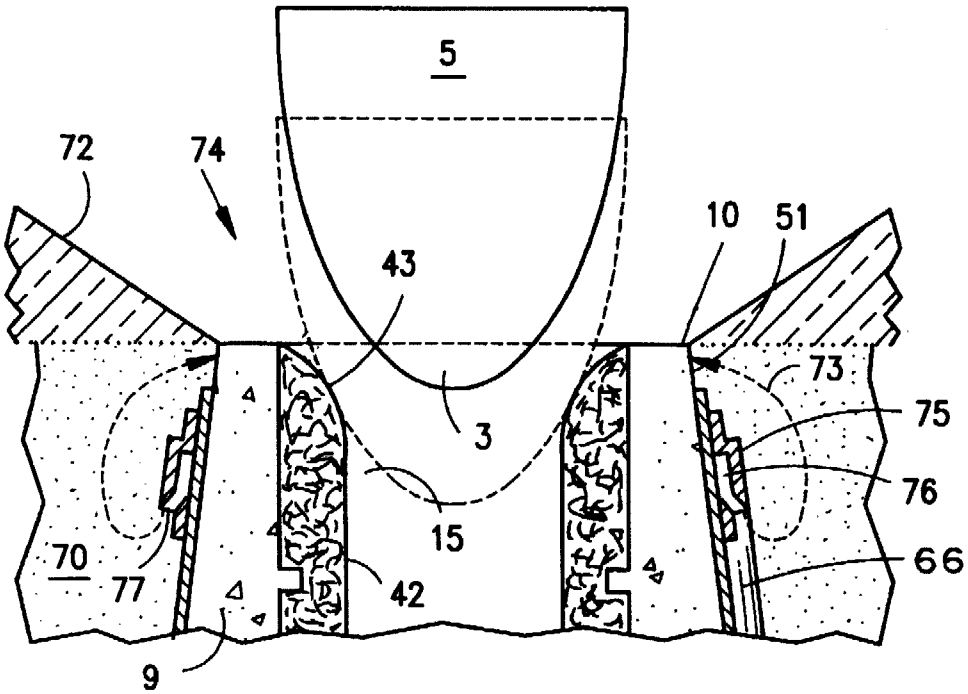
FIG. 5 is a partial cross-sectional side view of a fourth embodiment wherein a double-skinned portion of the sheathing material comprises the inert gas distributor.

FIG. 5 represents a fourth embodiment 74 of the invention which is identical in structure and operation to the previously-described third embodiment 62 with the exception that the tubular annular head 64 is replaced with a double-skinned portion 75 of the metal sheathing 50. This double-skinned portion forms an annular flow cavity 76 by which inert gas ultimately flows out through a plurality of uniformly spaced flow openings 77. While not specifically shown in the drawing, the upper and lower flange of the double-skinned portion 75 are brazingly sealed around the top end of the metal sheathing 50 so that pressurized inert gas entering the annular flow cavity 76 can only flow out through the flow passages 77. As with the previously described embodiments, an inert gas flow of between 5 and 15 liters per minute (or 10 to 30 scfh) is preferred.

While this invention has been described with respect to four preferred embodiments, different variations, modifications, and additions to the invention will become evident to persons of ordinary skill in the art. All such modifications, variations, and additions are intended to be encompassed within the scope of this patent, which is limited only by the claims appended hereto.

What is claimed:

1. A refractory nozzle assembly for controlling a flow of molten metal, comprising:

a nozzle body having an upper portion and a lower portion formed from a refractory material, and a bore having a receiving end and a discharge end for receiving and discharging molten metal, respectively, said receiving end of said bore being circumscribed by said upper portion of said nozzle body;

a gas distributing means circumscribing said upper portion of said nozzle body for uniformly distributing a pressurized inert gas flow at all points around a top edge of said upper portion, and means lining said bore for obstructing pressurized inert gas from flowing through the walls of the upper portion of said nozzle body and into the bore such that said inert gas flows substantially exclusively over the top edge of said upper portion, said lining means circumscribing at least said receiving end of said bore and extending to said top edge of said upper portion of the nozzle body.

2. The refractory nozzle assembly defined in claim 1, wherein said upper portion of the nozzle body is formed from a refractory material having porosity of at least 15% so as to be gas conducting, and wherein said lining means is a sleeve of refractory material having a porosity less than 15% so as to be gas obstructing, and said gas distributing means conducts said pressurized gas flow only through said upper portion.

3. The refractory nozzle assembly defined in claim 1, further comprising a layer of impermeable material disposed around the outside of said nozzle assembly for confining said flow of pressurized inert gas through said upper portion of the nozzle body to the top edge of said portion.

4. The refractory nozzle assembly defined in claim 3, wherein said outside layer of impermeable material is formed from a metallic sheath that surrounds the outside surface of said nozzle body.

5. The refractory nozzle assembly defined in claim 1, wherein said gas-distributing means includes a refractory material having a porosity between 20% and 30% forming said upper portion of said nozzle body, and a conduit having a gas outlet end in contact with the refractory material forming said upper portion of said nozzle body, and an inlet end extending through the refractory material forming said lower portion of said nozzle body that is connected to a source of pressurized, inert gas.

6. The refractory nozzle assembly defined in claim 5, wherein said gas-distributing means further includes an annular, gas-conducting groove circumscribing a bottom surface of the refractory material forming said upper portion of said nozzle body.

7. The refractory nozzle assembly defined in claim 5, wherein said gas-distributing means further includes an annular, gas-conducting groove circumscribing a side surface of the refractory material forming said upper portion of said nozzle body.

8. The refractory nozzle assembly defined in claim 1, wherein said gas-distributing means includes an annular conduit circumscribing the upper portion of the nozzle body having a plurality of gas-conducting openings for uniformly distributing inert gas around said upper portion.

9. The refractory nozzle assembly defined in claim 8, wherein said gas-conducting openings face said lower portion of said nozzle body to avoid clogging from surrounding ramming material.

10. The refractory nozzle assembly defined in claim 9, wherein said the outside of said nozzle body is covered by a gas impermeable metallic sheath, and said annular conduit is formed from a double-skinned portion of said sheath.

11. A refractory nozzle assembly for use in combination with a stopper rod for controlling a flow of molten metal, comprising:

a nozzle body having an upper portion, and a lower portion formed from a refractory material, and a bore extending through said refractory materials forming said upper and lower portions having a receiving end and a discharge end for receiving and discharging molten metal, respectively, said receiving end of said bore being circumscribed by said upper portion of said nozzle body and having a seat portion for sealingly engaging a stopper rod;

a gas-distributing means circumscribing said upper portion of said nozzle body for uniformly distributing a pressurized inert gas flow at all points around a top edge of said upper portion of said nozzle body;

a sleeve of refractory material covering the refractory material forming the upper portion of said bore for obstructing pressurized inert gas from flowing through the upper portion of the bore defined by said refractory material and into molten metal flowing through said bore and for providing a seat portion for receiving a stopper rod, said sleeve having a porosity less than the porosity of the refractory material forming said upper portion said sleeve extending to the top edge of said upper portion of said nozzle body, and a metallic sheath substantially covering the outside of the upper portion of the nozzle body, wherein said sleeve and said sheath cooperate to direct a flow of inert gas from said gas-distributing means substantially exclusively over the top edge of said upper portion of said nozzle body to shield said seat portion of said bore from exposure to ambient oxygen.

12. The refractory nozzle assembly defined in claim 11, wherein said gas distributing means includes a conduit disposed between said sleeve and said sheath and having an outlet end in communication with said upper portion of said nozzle body.

13. The refractory nozzle assembly defined in claim 12, wherein said gas distributing means further includes an annular groove in said refractory material forming said upper portion for conducting inert gas from said outlet end of said conduit around said upper portion.

14. The refractory nozzle assembly defined in claim 13, wherein said groove is located on a lower wall of said refractory material forming said upper portion.

15. The refractory nozzle assembly defined in claim 13, wherein said groove is located on a sidewall of said refractory material forming said upper portion.

16. The refractory nozzle assembly defined in claim 11, wherein said gas distributing means includes an annular conduit circumscribing the metallic sheath substantially covering said upper portion having a plurality of gas-conducting openings for uniformly distributing a flow of inert gas around said upper portion.

17. The refractory nozzle assembly defined in claim 16, wherein said gas conducting openings face said lower portion of said nozzle body to avoid clogging by ramming material surrounding the nozzle body.

18. The refractory nozzle assembly defined in claim 16, wherein said conduit is an annular metallic pipe affixed to said metallic sheath.

19. The refractory nozzle assembly defined in claim 16, wherein said conduit is an annular, double-skinned portion of said metallic sheath.

20. The refractory nozzle assembly defined in claim 11, wherein said gas distributing means includes a source of pressurized inert gas for generating a flow of inert gas at a rate of 15 liters per minute.

21. The refractory nozzle assembly defined in claim 11, wherein said upper portion of said nozzle body is formed from a refractory material having a porosity of between about 25% and 30% so as to be gas conducting, and wherein said gas distributing means conducts said flow of inert gas through said upper portion.

22. The refractory nozzle assembly defined in claim 21, wherein said lower portion of said nozzle body is formed from a castable alumina refractory material having a porosity of between about 15% and 20%.

23. A refractory nozzle assembly for controlling a flow of molten metal, comprising:

a nozzle body having an upper portion formed from a refractory material having a porosity of at least 15% as to be gas conducting, and a lower portion formed from a refractory material, and a bore extending through said refractory materials forming said upper and lower portions having a receiving end and a discharge end for receiving and discharging molten metal, respectively, said receiving end of said bore being circumscribed by said upper portion of said nozzle body;

a gas-distributing means circumscribing said upper portion of said nozzle body for conducting a flow of pressurized, inert gas through only said upper portion of said nozzle body and uniformly distributing said flow of gas at all points around a top edge of said upper portion;, and means lining said bore for obstructing pressurized inert gas from flowing through the walls of the bore defined by said upper portion of said nozzle body and for redirecting said inert gas so that it flows substantially exclusively through the top edge of said upper portion and shields said top edge from exposure to ambient oxygen, said sleeve extending to the top edge of the upper portion of said nozzle body.

* * * * *